US012012674B2

(12) United States Patent
Maes et al.

(10) Patent No.: US 12,012,674 B2
(45) Date of Patent: Jun. 18, 2024

(54) RAPIER WEAVING MACHINE WITH GUIDING DEVICE AND METHOD FOR CONVERTING A RAPIER WEAVING MACHINE

(71) Applicant: VANDEWIELE NV, Kortrijk / Marke (BE)

(72) Inventors: Geert Maes, Gullegem (BE); Vincent Lampaert, Vichte (BE)

(73) Assignee: VANDEWIELE NV, Kortrijk/Marke (BE)

( * ) Notice: Subject to any disclaimer, the term of this patent is extended or adjusted under 35 U.S.C. 154(b) by 60 days.

(21) Appl. No.: 18/011,033

(22) PCT Filed: Jun. 15, 2021

(86) PCT No.: PCT/IB2021/055259
§ 371 (c)(1),
(2) Date: Dec. 16, 2022

(87) PCT Pub. No.: WO2021/260490
PCT Pub. Date: Dec. 30, 2021

(65) Prior Publication Data

US 2023/0272562 A1 Aug. 31, 2023

(30) Foreign Application Priority Data

Jun. 25, 2020 (BE) ..... 2020/5469

(51) Int. Cl.
*D03D 47/27* (2006.01)
*D03D 47/23* (2006.01)
*D03D 49/50* (2006.01)

(52) U.S. Cl.
CPC ..... *D03D 47/277* (2013.01); *D03D 47/233* (2013.01)

(58) Field of Classification Search
CPC ..... D03D 47/277; D03D 47/233; D03D 47/20
See application file for complete search history.

(56) References Cited

U.S. PATENT DOCUMENTS 4,185,667 A * 1/1980 Kendrick ..... D03D 45/62 139/453
5,033,516 A * 7/1991 Debaes ..... D03D 47/277 139/449
5,176,185 A * 1/1993 Rheinganz ..... D03D 47/277 139/449

(Continued)

FOREIGN PATENT DOCUMENTS

EP 0312031 A1 4/1989
EP 0971059 A1 1/2000

(Continued)

OTHER PUBLICATIONS

International Search Report and Written Opinion for PCT/IB2021/0552; mailing date of Jul. 27, 2021.

*Primary Examiner* — Robert H Muromoto, Jr.
(74) *Attorney, Agent, or Firm* — FRESH IP PLC; Clifford D. Hyra; Aubrey Y. Chen

(57) ABSTRACT

A rapier weaving machine and a method for converting an existing rapier weaving machine into a rapier weaving machine, which includes an insert rapier head for inserting a weft yarn into a fabric, a receiver rapier head for receiving and holding the weft yarn and subsequently pulling the weft yarn out of the fabric in a movement direction, an opening element for opening the receiver rapier head in order to release the weft yarn, and a guiding device, positioned on the side of the receiver rapier head opposite the opening element, and comprising a guiding block for adjusting the movement direction of the receiver rapier head, and a rotatable guiding wheel for restraining the receiver rapier head when opening.

3 Claims, 3 Drawing Sheets

(56) References Cited

U.S. PATENT DOCUMENTS 5,183,083 A * 2/1993 Debaes ..... D03D 47/273 139/449
5,183,084 A * 2/1993 Moeneclaey ..... D03D 47/277 139/449
5,303,747 A * 4/1994 Arndt ..... D03D 47/23 139/449
5,413,151 A * 5/1995 Moeneclaey ..... D03D 47/277 139/449
5,950,686 A * 9/1999 Herrlein ..... D03D 47/276 384/99
6,161,597 A * 12/2000 Meyns ..... D03D 47/277 139/449
6,276,403 B1 * 8/2001 Shaw ..... D03D 47/272 139/449
6,367,515 B1 * 4/2002 Roelstraete ..... D03D 47/277 139/449
6,988,516 B2 * 1/2006 Debaes ..... D03D 47/275 139/447
7,520,303 B2 * 4/2009 Mertens ..... D03D 27/10 139/116.5
9,732,450 B2 * 8/2017 Halsberghe ..... D03D 47/236
11,746,449 B2 * 9/2023 Verscheure ..... D03D 47/277 139/449
2003/0056849 A1 * 3/2003 Debaes ..... D03D 47/273 139/449
2007/0006932 A1 * 1/2007 Mertens ..... D03D 39/16 139/37
2016/0273136 A1 * 9/2016 Halsberghe ..... D03D 47/236
2022/0220645 A1 * 7/2022 Verscheure ..... D03D 47/277

FOREIGN PATENT DOCUMENTS

EP 3483318 A1 * 5/2019 ..... D03D 47/236
EP 3483318 A1 5/2019

* cited by examiner

RAPIER WEAVING MACHINE WITH GUIDING DEVICE AND METHOD FOR CONVERTING A RAPIER WEAVING MACHINE

This application is a National Phase entry of International Application No. PCT/IB2021/055259 under § 371 and claims the benefit of Belgian Patent Application No. BE2020/5469, filed Jun. 25, 2020, which is hereby incorporated by reference in its entirety.

FIELD OF THE DISCLOSURE

This disclosure relates to a rapier weaving machine, comprising an insert rapier head, for inserting a weft yarn into a fabric, a receiver rapier head for receiving the weft yarn from the insert rapier head, holding the weft yarn, and subsequently pulling the weft yarn out of the fabric in a movement direction, an opening element, for opening the receiver rapier head to release the weft yarn, and a guiding device, positioned on the side of the receiver rapier head opposite of the side where the opening element is positioned, for restraining the receiver rapier head when opening this receiver rapier head, wherein this guiding device comprises a guiding block, for adjusting the movement direction of the receiver rapier head.

BACKGROUND

Rapier weaving machines comprise one or more rapiers for inserting weft yarns into a shed between warp yarns to form a fabric. A weft yarn inserted by means of one or more rapiers is beaten against the already formed fabric by means of a reed. This is repeated in successive weft insertion cycles in order to form the fabric.

In rapier weaving machines with double rapiers, a weft yarn is brought halfway through the shed by means of an insert rapier head, and a receiver rapier head then takes over this weft yarn in order to hold the weft yarn and pull it out of the fabric. In order to hold the weft yarn, the receiver rapier head typically comprises a clamping element for clamping the weft yarn. When the weft yarn is pulled out of the fabric, the opening element opens the receiver rapier head in order to release the weft yarn. Examples of such an opening element are described and illustrated in U.S. Pat. No. 5,271,434 A and in EP 0 971 059 A1, for instance.

For the successive weft insertion cycles, accurate positioning of the rapier heads is of great importance. For this purpose, the rapier heads are mounted on rigid rapier rods, such that the rapier heads and the rapier rods jointly form the rapiers. By means of these rapier rods, the rapier heads in the rapier weaving machine are moved through the shed. In order to guarantee the position of the rapier heads as much as possible, it is intended that in the rapier weaving machines to which this disclosure is related the rapier rods move against the reed. This way, the lateral position of the rapier heads is largely guaranteed. The movement direction of the rapier rods is forced in the direction of the reed, and their forward movement is not entirely straight. When the receiver rapier head is pulled out of the fabric, the movement direction of the receiver rapier head is adjusted by means of a guiding block. In these rapier weaving machines, this guiding block is positioned on the side of the receiver rapier head opposite from the side where the opening element is positioned, such that this guiding block also serves to restrain the receiver rapier head when this receiver rapier head is opened by means of the opening element. As a result, this guiding block is subject to strong wear and tear. A rapier weaving machine rapier with a guiding device with such a guiding block is described and illustrated, for instance, in EP 3 486 318 A1.

SUMMARY

It is an object of embodiments of this disclosure to limit the wear and tear of the aforementioned guiding block.

This object may be achieved by providing such a rapier weaving machine, in which the guiding device comprises a guiding block for adjusting the movement direction of the receiver rapier head, and a guiding wheel, positioned rotatably in the guiding device, for restraining the receiver rapier head by means of this guiding wheel when it is opened.

For the adjustment of the movement direction of the receiver rapier head, such a guiding wheel is less suited than the used guiding block. In order to adjust this movement direction, a guiding block is maintained, such that this function is optimally maintained in the new guiding device.

The guiding wheel only guides the receiver rapier head when the opening element opens the receiver rapier head. Even though it is intended that the receiver rapier head does not move a lot at the moment that the opening element opens the receiver rapier head, in practice, there is often a small movement, which was the primary cause of the aforementioned wear and tear. By combining a guiding block in the guiding device according to this disclosure with a guiding wheel, wear and tear of the guiding block can be significantly reduced. The guiding wheel only makes contact with the receiver rapier head, and more specifically, only with the receiver rapier head, when the receiver rapier head is at the level of the opening element. Therefore, this guiding wheel only serves to absorb the impact of the opening element on the receiver rapier head, and this at relatively low speeds, since the speed of the receiver rapier head is already greatly reduced when it is pulled out of the fabric.

Such a rapier weaving machine may also comprise more receiver rapier heads. Per receiver rapier head, preferably, an aforementioned guiding block and an aforementioned guiding wheel are provided. Per receiver rapier head, this guiding block and this guiding wheel may be part of a separate guiding device according to this disclosure. Alternatively, it is also possible that the guiding blocks and the guiding wheels for the different receiver rapier heads are included in a single guiding device according to this disclosure.

The object of this disclosure may furthermore also be achieved with the same advantages, by providing a method for converting a rapier weaving machine comprising an insert rapier head for inserting a weft yarn into a fabric, a receiver rapier head for receiving the weft yarn from the insert rapier head, holding the weft yarn, and subsequently pulling the weft yarn out of the fabric in a movement direction, an opening element for opening the receiver rapier head to release the weft yarn, and a guiding device, positioned on the side of the receiver rapier head opposite of the side where the opening element is positioned, for restraining the receiver rapier head when opening this receiver rapier head, and comprising a guiding block for adjusting the movement direction of the receiver rapier head.

In a first embodiment of a method according to this disclosure, the guiding device of the rapier weaving machine is replaced by an above described guiding device according to this disclosure.

In a second embodiment of a method according to this disclosure, the guiding device is converted to an above described guiding device according to this disclosure. This may be accomplished, for instance, by adding to this guiding device a guiding wheel, provided rotatably in this guiding device.

In each of the embodiments of a method according to this disclosure, an above described rapier weaving machine according to this disclosure is formed.

BRIEF DESCRIPTION OF THE DRAWINGS

This invention is now explained in further detail based on the following description of at least one embodiment of a rapier weaving machine and of a method according to this invention. The purpose of this description is exclusively to provide clarifying examples and to indicate further advantages and particularities of the invention, and it can therefore not be interpreted as a limitation of the field of application of the invention or of the patent rights claimed in the patent claims.

In this description, reference numbers refer to the enclosed drawings, in which.

DETAILED DESCRIPTION

Figure 1:
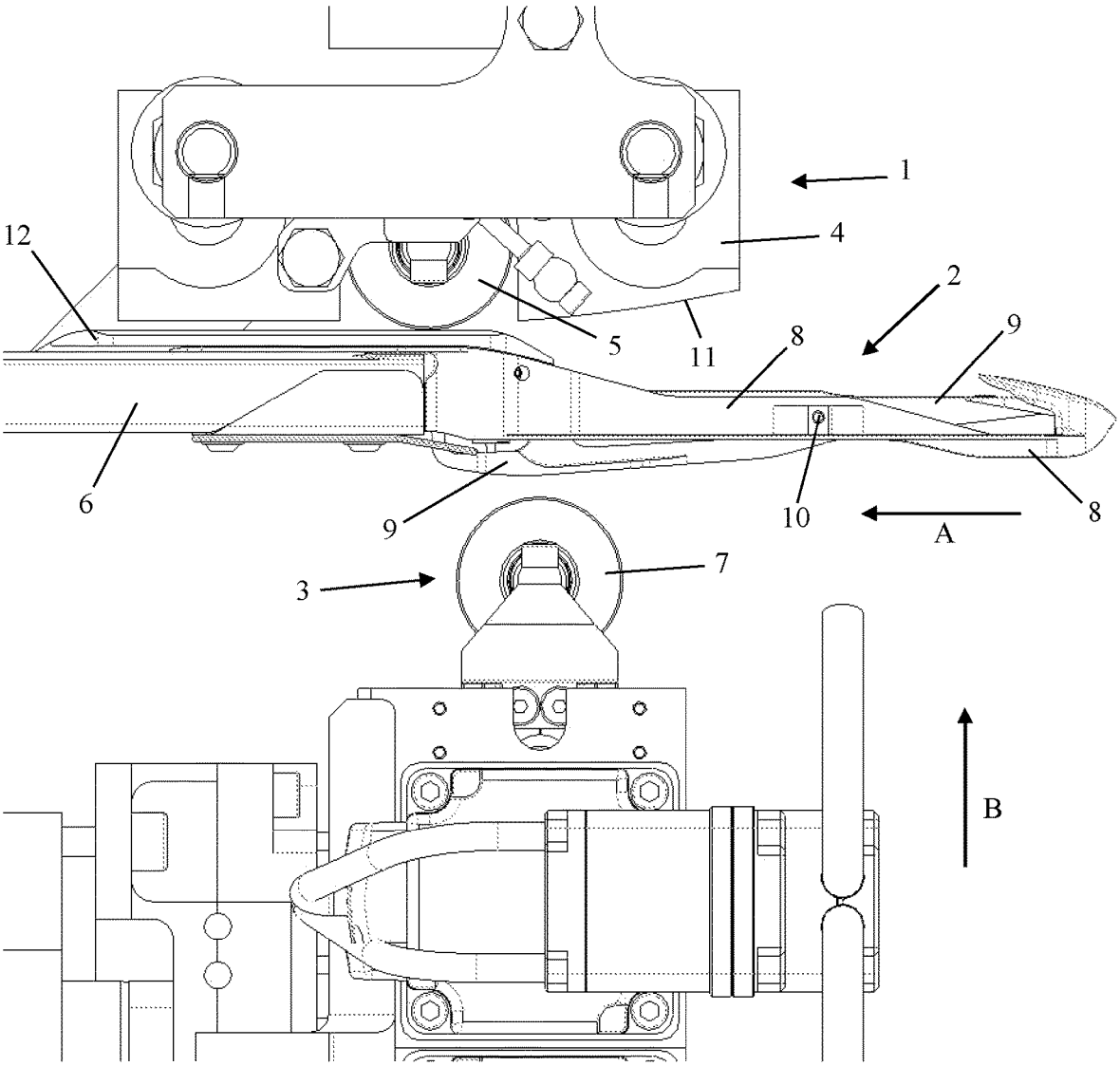
FIG. 1, in a part of a rapier weaving machine according to this disclosure, the guiding device is shown in a top view.
Figure 2:
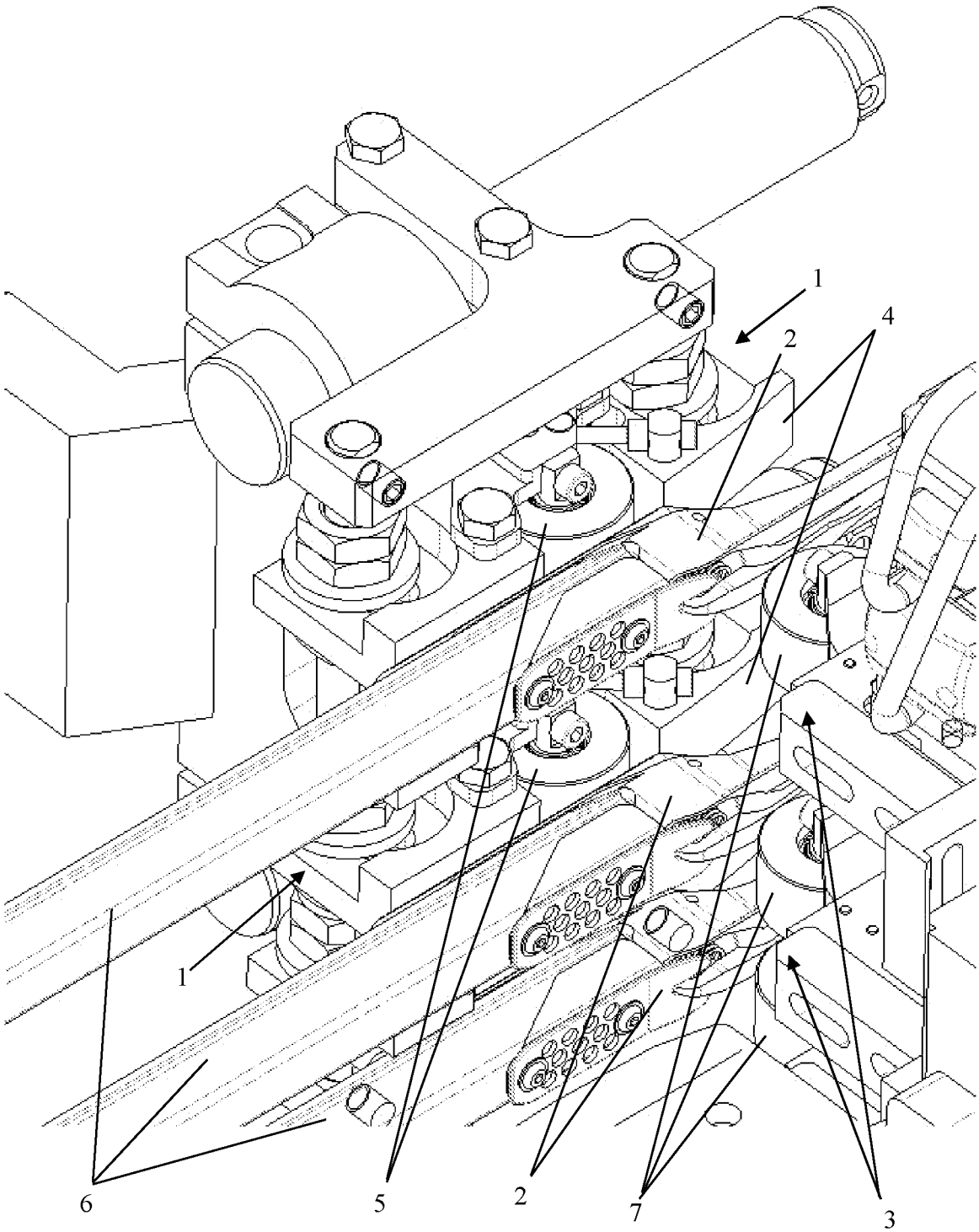
FIG. 2, in a part of the rapier weaving machine of FIG. 1, guiding devices are shown in perspective.
Figure 3:
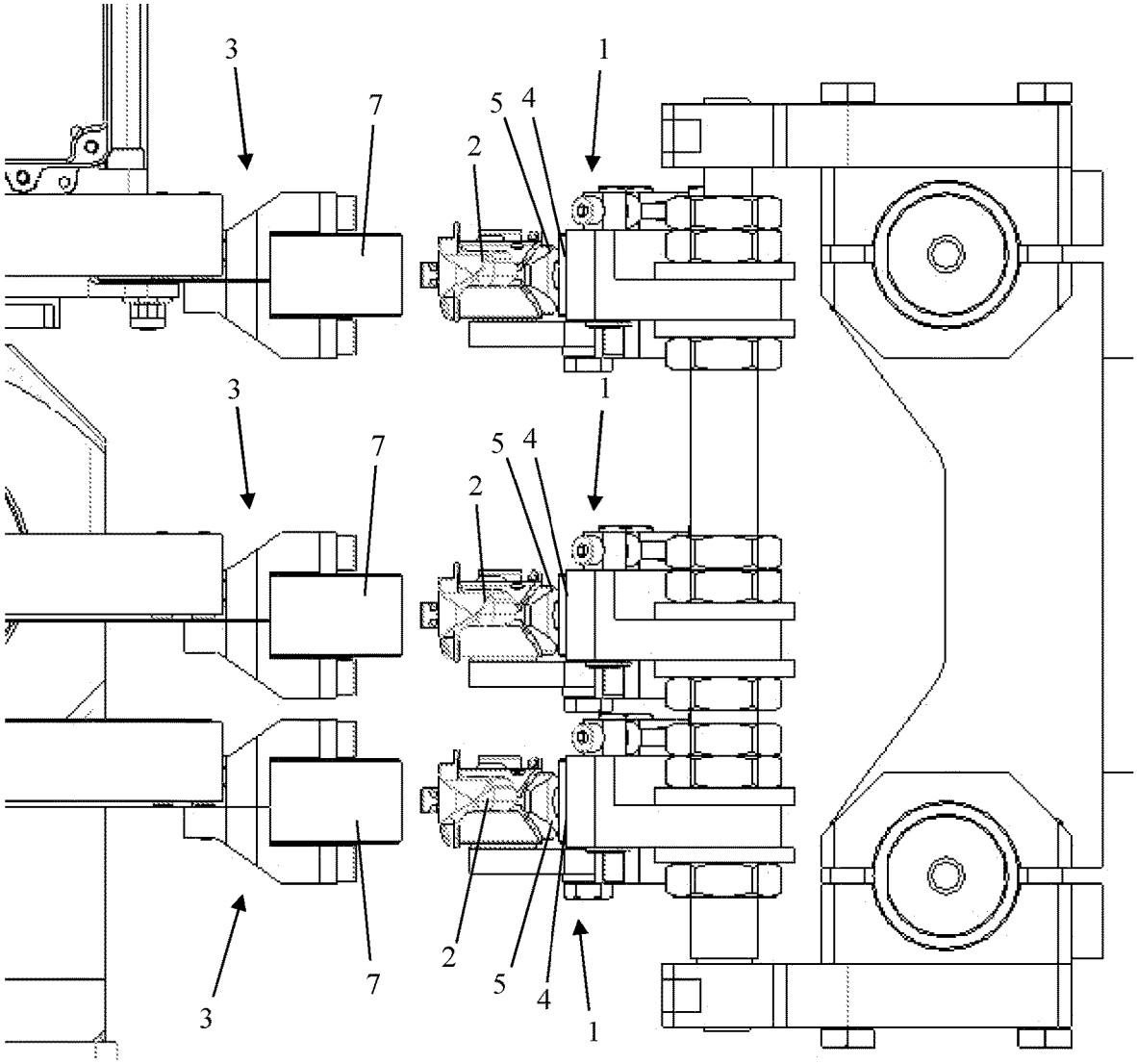
FIG. 3, in a part of the rapier weaving machine of FIG. 1, guiding devices are shown in a side view.

The illustrated rapier weaving machine according to this disclosure comprise three insert rapier heads, not shown here, each of which is provided for inserting a weft yarn from a first side of the machine into a shed formed between warp yarns in this machine.

The three illustrated receiver rapier heads (2) are each provided in order to receive a weft yarn halfway through the shed from a corresponding insert rapier head, to hold it, and to pull it out of the shed on a second side of the machine, opposite from the first side. For these purposes, each receiver rapier head (2) is attached to a rapier rod (6), and is movable in the movement direction (A) by means of this rapier rod (6). Each receiver rapier head (2) and its corresponding rapier rod (6) jointly form a receiver rapier. In order to be able to receive a weft yarn and hold it, each receiver rapier head (2) comprises a fixed leg (8) and a movable leg (9), which has a hinged connection with the fixed leg (8) by means of a pivot pin (10). The legs (8, 9) jointly form a gripping element (clamping element) for gripping (clamping) the weft yarn.

On the second side of the machine, for each receiver rapier head, a depicted opening element (3) is positioned, which is movable to this receiver rapier head (2) and away from this receiver rapier head (2). When the receiver rapier head (2) moves out of the shed and arrives at the level of this opening element (3), the opening element (3) moves in the movement direction (B) towards the receiver rapier head (2) and engages the movable leg (9) in order to pivot this movable leg (9) relative to the fixed leg (8) in order to open the receiver rapier head (2). The weft yarn is thereby released.

A weft yarn inserted by means of an insert rapier head and a corresponding receiver rapier head is beaten against the already formed fabric by the reed of the rapier weaving machine in order to form the desired fabric.

The opening elements (3) are located on the second side of the machine, preferably as close as possible to the edge of the fabric, in order to keep the loose ends of the weft yarn as short as possible.

Each illustrated opening element (3) is provided with a rotatably positioned engaging wheel (7) in order to engage the movable leg (9) of the corresponding receiver rapier head (2) by means of this engaging wheel (7).

When a receiver rapier head (2) must be opened, the opening element (3), and therefore its engaging wheel (7) as well, move in the movement direction (B) toward the receiver rapier head (2) in order to push against the movable leg (9) of the receiver rapier head (2) and thus to open the receiver rapier head (2).

For these purposes, the opening elements (3) are controlled independently of each other by way of a servomechanism.

On the side of each receiver rapier head (2) opposite of the side on which the corresponding opening element (3) is positioned, a guiding device (1) according to this disclosure is positioned.

In order to adjust the movement direction (A) of a receiver rapier head (2) when this receiver rapier head (2) leaves the shed, each guiding device (1) is provided with a guiding block (4) with an engagement surface (11). Viewed in the movement direction (A) of the receiver rapier head (2), the engagement surface (11) is positioned obliquely toward the opening element (3). When leaving the fabric, the corresponding receiver rapier head (2) is pushed against the movement direction (B) of the opening element (3) by this engagement surface (11). When in use, the guiding block (4) is fixed positioned in the rapier weaving machine, whereby the position of this guiding block (4) is adjustable.

Viewed in the movement direction (A) of the receiver rapier head (2), a guiding wheel (5) is positioned is after the engagement surface (11) of each guiding device (1). This guiding wheel (5) is rotatably attached to the guiding block (4) and protrudes toward the opening element (3) relative to the engagement surface (11). The guiding wheel (5) guides the corresponding receiver rapier head (2) when the corresponding opening element (3) opens the receiver rapier head (2), thereby restraining the receiver rapier head (2). The guiding wheel (5) absorbs the impact of the opening element (3) on the receiver rapier head (2).

In order to limit the torsional load, this guiding wheel guide (5) is preferably positioned as close as possible to the point where the corresponding opening element (3) engages the receiver rapier head (2) in order to open the receiver rapier head (2).

In order to limit the friction between a receiver rapier and the corresponding guiding device (1) as much as possible when they contact each other, each receiver rapier is provided with a wear part (12) made from a material with a greater resistance to wear than the rest of the receiver rapier. This wear part (12) is attached above the connection of the receiver rapier head (2) to the rapier rod (6) of the receiver rapier. In order to limit the torsional load, this wear part (12) is preferably positioned as close as possible to the point at which the corresponding opening element (3) engages the receiver rapier head (2) in order to open the receiver rapier head (2).

Thus, in at least one embodiment, an existing rapier weaving machine comprises:

- at least one insert rapier head for inserting a weft yarn into a fabric;
- at least one receiver rapier head (2) for receiving the weft yarn from the insert rapier head, holding the weft yarn, and subsequently pulling the weft yarn out of the fabric in a movement direction (A);
- at least one opening element (3) for opening the receiver rapier head (2) to release the weft yarn; and at least one guiding device (1), positioned on the side of the receiver rapier head (2) opposite of the side where the opening element (3) is positioned, for restraining the receiver rapier head (2) when opening this receiver rapier head (2), wherein this guiding device comprises a guiding block (4) for adjusting the movement direction (A) of the receiver rapier head (2);

can be converted into a rapier weaving machine according to this disclosure by providing each guiding block (4) with a rotatable guiding wheel (5) for restraining the corresponding receiver rapier head (2) when opening this receiver rapier head (2). Alternatively, this rapier weaving machine can also be converted into a rapier weaving machine according to this disclosure by replacing each of the aforementioned guiding device of this rapier weaving machine by a guiding device (1) that comprises such a guiding block (4) as well as such a such rotatable guiding wheel (5).

The invention claimed is:

1. A rapier weaving machine, comprising:

an insert rapier head for inserting a weft yarn into a fabric, a receiver rapier head for receiving the weft yarn from the insert rapier head, for holding the weft yarn, and subsequently pulling the weft yarn out of the fabric according to a direction of movement (A), an opening element for opening the receiver rapier head in order to release the weft yarn, and a guiding device positioned on the side of the receiver rapier head, which is opposite the side where the opening element is positioned, for restraining the receiver rapier head when opening this receiver rapier head, and comprising a guiding block for adjusting the direction of movement (A) of the receiver rapier head, wherein the guiding device of this rapier weaving machine comprises a guiding wheel positioned rotatably in the guiding device, for restraining the receiver rapier head by means of this guiding wheel when it is opened.

2. A method for converting a rapier weaving machine comprising an insert rapier head for inserting a weft yarn into a fabric, a receiver rapier head for receiving the weft yarn from the insert rapier head, for holding the weft yarn, and subsequently pulling the weft yarn out of the fabric according to a direction of movement (A), an opening element for opening the receiver rapier head in order to release the weft yarn, and a guiding device arranged on the side of the receiver rapier head, opposite the side where the opening element is positioned, for restraining the receiver rapier head, when opening this receiver rapier head, and comprising a guiding block for adjusting the direction of movement (A) of the receiver rapier head, wherein the guiding device is replaced by a guiding device that comprises a guiding block for adjusting the direction of movement (A) of the receiver rapier head, and a guiding wheel positioned rotatably in the guiding device for restraining the receiver rapier head by means of this guiding wheel when it is opened.

3. A method for converting a rapier weaving machine comprising an insert rapier head for inserting a weft yarn into a fabric, a receiver rapier head for receiving the weft yarn from the insert rapier head, for holding the weft yarn, and subsequently pulling the weft yarn out of the fabric according to a direction of movement (A), an opening element for opening the receiver rapier head in order to release the weft yarn, and a guiding device, positioned on the side of the receiver rapier head, opposite the side where the opening element is positioned, for restraining the receiver rapier head when opening this receiver rapier head, and comprising a guiding block for adjusting the movement direction (A) of the receiver rapier head, wherein the guiding device is converted into a guiding device that comprises a guiding block for adjusting the movement direction (A) of the receiver rapier head, and a guiding wheel, positioned rotatably in the guiding device, for restraining the receiver rapier head by means of this guiding wheel when it is opened.

* * * * *